United States Patent [19]

Dommer et al.

[11] 4,419,929

[45] Dec. 13, 1983

[54] PRESS DRIVE

[75] Inventors: Hans-Martin Dommer, Goppingen; Alfred Bareis, Uhingen; Ewald Bergmann, Rechberghausen, all of Fed. Rep. of Germany

[73] Assignee: L. Schuler GmbH, Fed. Rep. of Germany

[21] Appl. No.: 348,015

[22] Filed: Feb. 11, 1982

[30] Foreign Application Priority Data

Feb. 11, 1981 [EP] European Pat. Off. ..... 81100932

[51] Int. Cl.[3] ..... B30B 1/26

[52] U.S. Cl. ..... 100/257; 83/530; 83/615; 83/626; 83/630; 100/286

[58] Field of Search ..... 83/615, 626, 630, 530; 100/257, 282, 286; 74/603

[56] References Cited

U.S. PATENT DOCUMENTS 4,160,409 7/1979 Portmann ..... 100/257

4,318,325 3/1982 Bareis ..... 100/257 X

*Primary Examiner*—Billy J. Wilhite

*Attorney, Agent, or Firm*—Craig & Burns

[57] ABSTRACT

A drive arrangement for a high speed mechanical press, especially a high speed cutting press, wherein the press drive includes two eccentric shafts connected by connecting rods with a slide. Mass balancing weights are provided for enabling a complete dynamic mass balancing, with the weights being articulated by additional rods and being moved in a direction opposite to the slide. The drive further includes at least three pairs of toggle or knee joint link arrangements, with the first arrangement being nearly horizontally disposed, the second arrangement being nearly vertically disposed, and the third arrangement being nearly vertically disposed and connected on the one hand with the slide and, on the other hand, with the mass balancing weights, with the pairs being arranged symmetrically with respect to the eccentric shafts.

15 Claims, 4 Drawing Figures

PRESS DRIVE

The present invention relates to a drive arrangement and, more particularly, to a drive arrangement for a high speed press, wherein a pair of eccentric shaft means, driven in opposite directions and meshing with one another, are mounted in the press haed, with the eccentric shaft means being connected with a press ram or punch by connecting elements disposed symmetrically with respect to one another, and with mass balance weights corresponding to reciprocating masses of the press being provided, with the mass balance weights acting in directions opposite the reciprocating masses.

In, for example, commonly assigned co-pending U.S. application Ser. No. 180,475, now U.S. Pat. No. 4,318,325 a press drive is proposed wherein a central cam shaft is actively connected through a connecting rod with a slide guided in a linear guide. Side bars are symmetrically articulated with respect to each other on the slide. Mass balancing weights are driven in opposed directions corresponding to reciprocating masses of the press, with the balancing weights being connected with the slide by other linkages. Pairs of toggle joint linkages are disposed symmetrically with respect to the cam shaft, with the pairs of toggle joint linkages including a first almost horizontally disposed toggle joint linkage that is articulated on the respective side bars and presents a bearing point on the press frame. A second almost vertically disposed toggle joint linkage that is connected with the first toggle joint linkage and is articulated so as to be guided by the press frame on the mass balancing weights. A third almost vertically disposed toggle joint linkage is articulated on the punch through a transmission bar with the first and second toggle joint linkages and is braced in a direction of motion of a punch on the press frame.

In Auslegeschrift No. 23 44 529, a press drive arrangement is proposed which includes a dynamic mass balance, with the press drive operating through two eccentric shafts driven in opposite directions and meshing with one another. A disadvantage of this proposed construction resides in the fact that in this high speed press, all masses including the reciprocating masses of the slide of the press are compensated by rotating compensating masses.

In, for example, Offenlegungsschrift No. 2,534,627 and corresponding U.S. Pat. No. 4,156,387 as well as in Offenlegungsschrift No. 2,534,628, further press drives are proposed which are constructed especially for high speed mechanical presses, with these press drives including a central eccentric shaft effectively connected to a slide block by connecting rods. Brackets and/or single armed levers are symmetrically articulated with respect to one another to the side block, by means of which brackets or arms a slide is indirectly movable through an additional articulation. The single armed levers are mounted on slide members, opposite the articulation of the slide block, with the slide members being fixedly mounted to the press frame. Push bars, which act on the slide and single armed levers, serve as additional points of articulation. Mass balance weights are provided by the connection points of the single armed levers with the push bars, acting in opposite directions, through additional connecting rods and double levers, with the weights permitting complete dynamic balancing of the masses. In this proposed arrangement, an eccentric bush, rotatable relative to an eccentric, is provided for enabling a stroke adjustment.

A dynamic behavior of a press, especially when operating or cutting at a high number of strokes per minute, is quite unfavorably influenced by an arrangement of the bearings in a power flow path and the arrangement of single armed levers so that, among other things, a depth of penetration of the upper tool into a lower tool of the press increases as the number of strokes increase since the amount of bearing clearance and also the elastic deformation of the single armed levers, subjected to bending stress considerably reduce the rigidity of the total system.

The aim underlying the present invention essentially resides in providing a press drive which includes a minumin number of bearings arranged in a power flow path while nevertheless achieving a complete dynamic mass balance, with the press drive being composed exclusively of components in the flow path which are exposed to compression and tension.

In accordance with advantageous features of the present invention, at least three pairs of toggle joint linkage means are provided with each of the first toggle joint linkage means being nearly horizontally disposed and articulated to a connecting rod linked to an eccentric shaft and having a supporting point on the press frame. Each of the second toggle joint linkage means are nearly vertically disposed and are respectively connected with the first toggle joint means and are articulated to a mass balancing weight provided with guide means by a stand of the press, Each of the third toggle joint linkage means are nearly vertically mounted and are respectively connected by a transmission bracket to the first toggle joint linkage means and to a slide or press ram by the second toggle joint linkage means. The third toggle joint linkage means are supported on the press frame in a direction of movement of the slide or press ram and are disposed symmetrically to the eccentric shaft.

In accordance with advantageous features of the present invention, the third toggle joint linkage means are constructed so as to enable the linkage means in a vicinity of a lower reversing point of the slide or press ram with the first toggle joint linkage means simultaneously passing through a bent position.

Advantageously, a length ratio of rods forming the respective second toggle joint linkage means is equal to a length of a ratio of rods of the third toggle joint linkage means, with the second and third toggle joint linkage means moving with angular synchronization.

In accordance with the present invention, each of the third toggle joint linkage means may be supported on a press frame by a slide adjustment means. Additionally, a support point of the respective first toggle joint linkage means may be constructed as a stroke adjustment device provided on the press frame.

Advantageously, in accordance with the present invention, the stroke adjustment device may be formed by a slide lock guidably displaced on a rectilinear guide means provided on the press frame.

It is also possible in accordance with the present invention, for the slide block of the stroke adjustment device to be movable by way of a threaded spindle operatively connected to a central worm shaft by a worm gear means.

The supporting point of the respective first toggle joint linkage means may be disposed on a lever which is fixedly secured to the frame of the press for pivotal movement, with the lever being articulated by a connecting bracket to a central slide block, which central slide block is adjustable by way of an adjusting spindle through a worm gear and an additional worm gear means.

Accordingly, it is an object of the present invention to provide a press drive arrangement for a high speed press which avoids, by simple means, shortcomings and disadvantages encountered in the prior art.

Another object of the present invention resides in providing a press drive arrangement for a high speed press which minimizes a number of bearings disposed in a power flow path of the press.

Yet another object of the present invention resides in providing a press drive arrangement for a high speed press which ensures a complete dynamic mass balancing.

A further object of the present invention resides in providing a drive arrangement for a high speed press which includes drive components arranged in a power flow path which are exposed to compression and tension but are not subjected to bending stress.

Yet another object of the present invention resides in providing a press drive arrangement for a high speed press wherein masses to be moved are reduced and a lighter construction may readily be achieved.

A further object of the present invention resides in providing a press drive arrangement for a high speed press which achieves a high degree of rigidity thereby resulting in reduced tool wear since a depth of penetration as well as the usual dynamic behavior of the press are positively influenced.

Another object of the present invention resides in providing a press drive arrangement having a stroke adjustment device which enables an advance of a feeder driven directly by the press drive to remain constant with a stroke adjustment.

A still further object of the present invention resides in providing a press drive arrangement for a high speed press which includes two eccentric shafts so as to permit a simple balancing of the rotating masses.

Another object of the present invention resides in providing a press drive arrangement for a high speed press which is rendered largely insensitive to eccentric loads during cutting by a construction using two eccentric shafts and connecting rods.

These and other objects, features, and advantages of the present invention will become more apparent from the following description when taken in connection with the accompanying drawings which show, for the purposes of illustration only, two embodiments in accordance with the present invention, and wherein.

Figure 1:
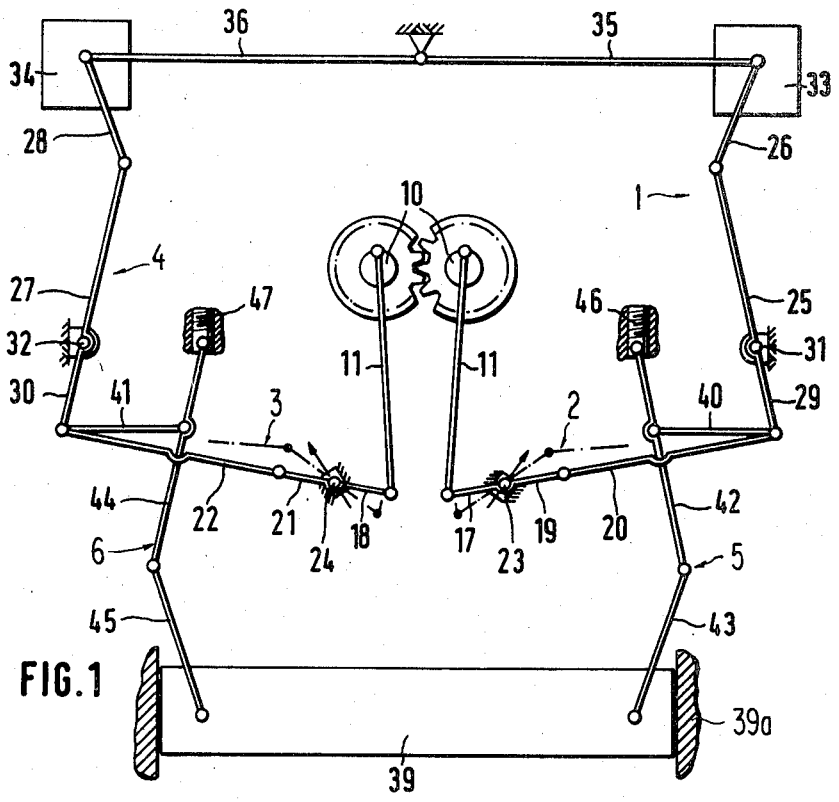
FIG. 1 is a schematic representation of a press drive arrangement constructed in accordance with the present invention, having a stroke adjustment means.
Figure 2:
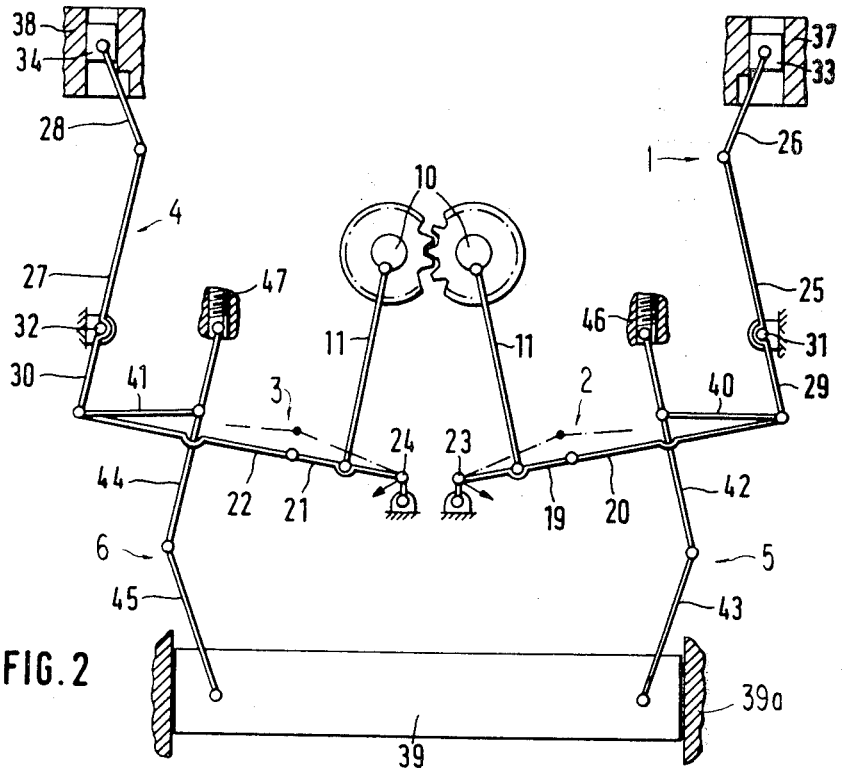
FIG. 2 is a schematic representation of another embodiment of a press drive arrangement constructed in accordance with the present invention provided with a modified stroke adjustment means.

Referring now to the drawings wherein like reference numerals are used throughout the various views to designate like parts and, more particularly, to FIGS. 1 and 2, according to these figures, a press drive is mounted in a press frame symmetrically with respect to two crank or eccentric shafts 10, with two connecting rods being respectively articulated to the eccentric shafts 10. In FIG. 1, the connecting rods 11 are respectively connected, by extensions 17, 18, to nearly horizontally disposed first toggle or knee joint linkage means generally designated by the reference numerals 2, 3. On of the first toggle joint linkage means 2 includes rods or links 19, 20, with the other toggle joint linkage means 3 including rods or links 21, 22. The first toggle joint linkage means 2, 3 are fixedly secured or mounted to the press frame through rods or links 19, 21 at support points 23, 24, with the rods or links 20, 22 are connected by extensions 29, 30 with nearly vertically disposed second toggle or knee joint linkage means generally designated by the reference numerals 1, 4. The second toggle joint linkage means includes rods or links 25, 26, with the other second toggle joint linkage means 4, including rods or links 27, 28. A second toggle joint linkage means 1, 4 are mounted by the rods 25, 27 and extensions 29, 30 to supports 31, 32 fixedly secured to the press frame. Mass balancing weights 33, 34 are articulated to the rods or links 26, 28 of the toggle joint links 1, 4 in such a manner that they are guided by the press frame. The expression "guided by the press frame" in the instant situation means that the mass balancing weights 33, 34 are either guided on rods 35, 36 (FIG. 1) on curves which nearly correspond to the tangents to the curves or are guided in guides 37, 38 (FIG. 2) which are integrally formed in the press frame, with the guides 37, 38 being disposed in parallel to guides 39*a* for guiding a slide or press ram 39.

Transmission brackets 40, 41 are articulated at the respective connecting points of extensions 29, 30 with rods 20, 22 of the first toggle joint linkage means 2, 3. The brackets 40, 41 are respectively connected directly with nearly vertically disposed third toggle linkage or knee joint means generally designated by the reference numerals 5, 6, with the third toggle joint linkage means 5 including rods or links 42, 43 and the toggle joint linkage means 6 including rods or links 44, 45. The slide 39 is articulated to the rods or links 43, 45, while the rods 42, 44 are fixedly supported at the press frame on slide adjusting devices 46, 47 of conventional construction.

The press drive of FIG. 2 differs from the press drive in FIG. 1 by virtue of the provision of the above-noted rectilinear guides 37, 38 for the mass balancing weights 33, 34 as well as the arrangement of the support points 23, 24. Moreover, in the illustrated example of FIG. 2, the extension 17, 18 may be omitted so that the connecting rods 11 are respectively connected directly with the rods 19, 20 of the first toggle joint linkage means 2, 3.

Figure 3:
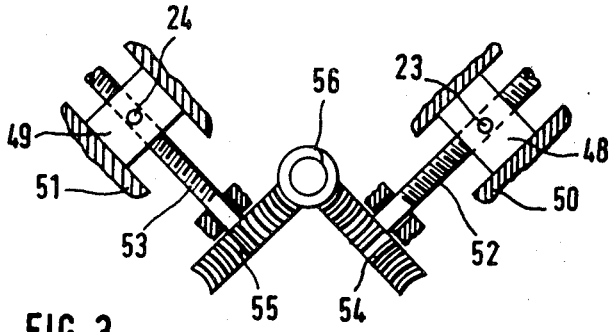
FIG. 3 is a partial schematic view, on an enlarged scale, of a stroke adjustment means of the press drive arrangement of FIG. 1.
Figure 4:
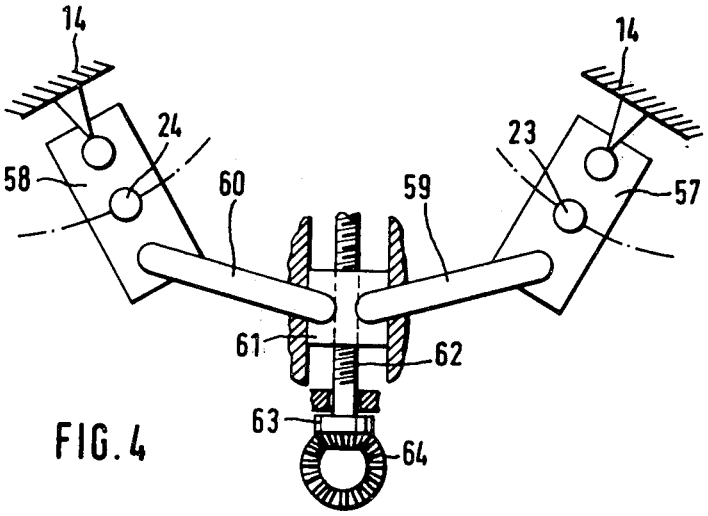
FIG. 4 is a partial schematic view, on an enlarged scale, of a stroke adjustment means of the press drive arrangement of FIG. 2.

The specific constructional features of the stroke adjustment means provided at the support points 23, 24 for the press drive arrangements of FIGS. 1 and 2 are more clearly illustrated in FIGS. 3 and 4, and FIG. 3 provides an example of a stroke adjustment means which may advantageously be used with a press drive of FIG. 1. More particularly, slide blocks 48, 49 are guided in rectilinear guides 50, 51 integrally formed with the press frame. The slide blocks 48, 49 are each adjusted by a threaded spindle 52, or 53, provided, at ends facing one another, with worm gears 54, 55, with the worm gears 54, 55 being driven by a common central worm shaft 56. The common central worm shaft 56 may either mannually or motor driven.

FIG. 4 provides an example of a stroke adjustment means which may preferably be used in the press drive of FIG. 2. In FIG. 4, the support points 23, 24 are disposed on pivotably mounted levers 57, 58 which are fixedly secured to the press frame. The pivotable levers 57, 58 are respectively connected by connecting brackets 59, 60 with a central slide block 61 adjustable by an adjusting spindle 62. The adjusting spindle 62 is driven by worm gears 63, 64 so that either manual or motor drive may be provided.

A comparison of the press drive of the present invention with, for example, a two point drive for a press drive such as proposed in the aforementioned Offenlegungsschrift No. 2,534,628, reveals that thirteen articulation points or bearing points out of a total of thirty one bearing points must be located in the power flow path, while in the comparable press drive of present invention, only six articulation points, that is, a minimum number of two joints out of a total of thirty-one articulation points are located in the power flow path.

In order to minimize distortion of a displacement path/time curve of the slide 39, which is caused by the third toggle joint linkage means 5, 6, the first toggle joint linkage means 2, 3 and the third toggle joint linkage means 5, 6 are positioned such that when a lower stationary point of the slide 39 is reached, the third toggle joint linkage means 5, 6 pass through an extended position, while the first toggle joint linkage means 2, 3 pass through a bent position. The second toggle joint linkage means 1, 4 simultaneously pass through a straight position so that when a length ratio of rods 25, 26 and 27, 28 of the second toggle joint linkage means 1, 4 are the same as those of rods 42, 43 and 44, 45 of the third toggle joint linkage means 5, 6, the mass balancing weights 33, 34 are correctly dimensioned, the rods and brackets of the press drive will have their masses balanced. The rods or links 25, 26 and 27, 28 of the second toggle joint linkage means 1, 4 are moved in exact pairwise angular synchronization and in opposite directions with the rods or links 42, 43 and 44, 45 of the third toggle joint linkage means 5, 6. However, the arrangement may so be constructed that the second and third toggle joint linkage means 1, 4 and 5, 6 may be driven pairwise in the same direction but in opposite sidewise directions.

If the supporting points 23, 24 constructed as stroke adjustment devices, when the stroke is changed, the change in the stroke may also be made in the mass balancing weights 33, 34 articulated to the rods or links 25, 26 and 27, 28 of the second toggle joint linkage means 1, 4.

While we have shown and described only two embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A press drive for a high speed press, the press drive including a pair of oppositely driven eccentric shaft means, connecting means for connecting the eccentric shaft means with a slide means of the press, and mass balancing weight means corresponding to reciprocating masses of the press and acting in a direction opposite to the reciprocating masses, characterized in that the connecting means includes at least three pairs of toggle joint linkage means, each pair of toggle joint linkage means are symmetrically disposed with respect to the eccentric shaft means, a pair of connecting rod means each having a first end respectively connected to the eccentric shaft means, the first pair of toggle joint means are each nearly horizontally disposed and are respectively connected to a second end of the connecting rod means, means are provided for supporting each of the pair of first toggle joint linkage means at a frame of the press, the second pair of toggle joint linkage means is nearly vertically disposed and each is respectively connected to the first toggle joint linkage means and the mass balancing weight means, and the third pair of toggle joint linkage means is nearly vertically disposed and are respectively connected to the slide means, means are provided for respectively articulatingly connecting each of the third toggle joint linkage means with the first pair of toggle joint linkage means, and in that means are provided for supporting each of the third pair of toggle joint linkage means on the frame of the press in a direction of movement of the slide means.

2. A press drive according to claim 1, characterized in that the means for respectively atriculatingly connecting each of the third toggle joint linkage means with the first pair of toggle joint linkage means includes a transmission bracket interposed between the respective toggle joint linkage means.

3. A press drive according to one of claims 1 or 2, characterized in that the third toggle joint linkage means and first toggle joint linkage means are arranged such that the third toggle joint linkage means assumes an extended position in a vicinity of a lower reversing point of the slide means and a first toggle joint linkage means simultaneously passes through a bent position.

4. A press drive according to claim 3, characterized in that each of the pair of second and third toggle joint linkage means includes a least a pair of articulatingly connected link means, a length ratio of the link means of the second toggle joint link means is equal to a length ratio of the link means of the third toggle joint link means, and in that the third toggle joint link means and the second toggle joint link means move with annular synchronization.

5. A press drive according to claim 4, characterized in that the means for supporting the third pair of toggle joint linkage means on the frame of the press includes a slide adjustment means.

6. A press drive according to claim 5, characterized in that the means for supporting each of the pair of first toggle joint linkage means at the frame of the press includes a means for adjusting a stroke of the slide means.

7. A press drive according to claim 6, characterized in that the means for adjusting a stroke of the slide means includes a slide block operatively respectively connected with the first toggle joint linkage means, and a guide means provided in the press frame for guiding a movement of the respective slide blocks.

8. A press drive according to claim 7, characterized in that the guide means is a rectilinear guide provided for each of the slide blocks.

9. A press drive according to claim 7, characterized in that means are provided for adjusting the slide blocks including a threaded spindle means threadably accommodated in the respective slide blocks, a gear means provided on the respective threaded spindle means, a central drive means engagable with the gear means for driving the respective threaded spindle means.

10. A press drive according to claim 9, characterized in that the gear means includes a worm gear provided on each threaded spindle means, and in that the drive means includes a central worm shaft engagable with the worm gears.

11. A press drive according to claim 9, characterized in that means are provided at the press frame for guiding a movement of the mass balancing weight means.

12. A press drive according to claim 11, characterized in that the means for guiding the movement of the mass balancing weight means includes a pair of link means having a first end connected to the mass balancing weight means and a second end connected to a fixed support means so as to enable the mass balancing weight means to traverse a predetermined guide path.

13. A press drive according to claim 11, characterized in that the means for guiding the movement of the mass balancing weight means includes guide means for accommodating the balancing weight means, said guide means disposed so as to extend substantially parallel to guides for the slide means.

14. A press drive according to claim 7, characterized in that the means for adjusting a stroke of the slide means includes a pair of levers pivotably mounted on the frame of the press, a central slide block arranged between the levers, a connecting bracket means for connecting the respective levers to the central slide block, and in that means are provided for adjusting a positioning of the central slide block.

15. A press drive according to claim 14, characterized in that a threaded adjusting spindle accommmodated in the central slide block a worm gear provided on the threaded spindle, and a drive worm gear engagable with the worm gear provided on the threaded spindle.

* * * * *